US010700452B2

(12) United States Patent
Lee et al.

(10) Patent No.: US 10,700,452 B2
(45) Date of Patent: Jun. 30, 2020

(54) CONNECTOR TERMINAL

(71) Applicant: 3M INNOVATIVE PROPERTIES COMPANY, St. Paul, MN (US)

(72) Inventors: Kok Hoe Lee, Singapore (SG); Saujit Bandhu, Singapore (SG); YunLong Qiao, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/409,953

(22) Filed: May 13, 2019

(65) Prior Publication Data

US 2019/0348779 A1 Nov. 14, 2019

Related U.S. Application Data

(60) Provisional application No. 62/670,907, filed on May 14, 2018.

(51) Int. Cl.
*H01R 11/12* (2006.01)
*H01R 4/18* (2006.01)

(52) U.S. Cl.
CPC ..... *H01R 11/12* (2013.01); *H01R 4/186* (2013.01)

(58) Field of Classification Search
CPC ... H01R 4/02–024; H01R 4/186; H01R 11/12
USPC ..... 439/875, 874
See application file for complete search history.

(56) References Cited

U.S. PATENT DOCUMENTS 1,708,193 A * 4/1929 Sherwood ..... H01R 43/12 439/874
4,692,121 A * 9/1987 Arbogast, Jr. ..... H01R 4/027 29/874
6,364,701 B1 * 4/2002 O'Sullivan ..... H01R 9/038 439/579
7,553,191 B2 * 6/2009 Su ..... H01R 13/5845 439/497
7,736,190 B2 * 6/2010 Yuan ..... H01R 4/02 439/516
10,033,116 B2 * 7/2018 Miyamoto ..... H01R 4/023

FOREIGN PATENT DOCUMENTS

WO WO 2018-060922 4/2018

* cited by examiner

*Primary Examiner* — Gary F Paumen
(74) *Attorney, Agent, or Firm* — Robert S. Moshrefzadeh

(57) ABSTRACT

An electrically conductive terminal generally extends along a first direction and includes a straight middle portion, a resiliently compressible mating portion extending from a first end of the middle portion for making contact with a conductive pad, and a terminating portion extending from a second end of the middle portion for making contact to a plurality of wires. The terminating portion includes a plurality of electrically connected segments separated by one or more walls and is configured to receive conductive ends of the plurality of wires in a one-to-one correspondence relationship. The terminating portion electrically connects the received wires.

13 Claims, 7 Drawing Sheets

CONNECTOR TERMINAL

TECHNICAL FIELD

The disclosure generally relates to electrically conductive terminals and cable assemblies.

BACKGROUND

Ground wires of a singular, non-contact type generally terminate in terminals that are identical to the terminals that terminate signal-pair wires. The ground wires of a singular non-contact type are not in physical contact with the insulator of the adjacent signal-pair wire. However, cable assembles including cables with interstitial wires have electrical advantages over singular, non-contact type such as reduction of crosstalk, more balanced cable configuration for near-errorless signal transmission, improved return loss etc. "Interstitial", in this context, refers to the position of the ground wire placed within a cable between or adjacent to, and in physical contact with the insulator of at least one of the signal-pair wires. Cables, for instance twin axial flat ribbon cables, with interstitial ground wires are preferable for direct to-board cable assemblies. In using interstitial wires in cable assemblies the number of wire termination regions at the contact portions of the terminals increases thus increasing the density of terminals.

SUMMARY

The various aspects and embodiments described herein relate to an electrically conductive terminal for receiving and making physical and electrical connection with plurality of wires of a cable. The disclosure also describes cable assemblies having a cable including plurality of insulated and uninsulated wires, and electrically conductive terminals for receiving and terminating the conductors of the insulated and uninsulated wires to isolate neighboring differential pairs without substantially increasing the density of the terminals.

An aspect of the present disclosure relates to an electrically conductive terminal for making solderless electrical contact with a conductive pad. The terminal generally extends along a first direction and includes a substantially straight conductive middle portion. A conductive mating portion extends from a first end of the middle portion generally along the first direction for making solderless electrical contact with a conductive pad. The mating portion is resiliently compressible in the first direction. A conductive terminating portion extends from an opposite second end of the middle portion generally along the first direction for making physical and electrical contact to a plurality of wires. The terminating portion includes a plurality of electrically connected segments separated by one or more electrically conductive walls. The electrically connected segments are configured to receive exposed conductive ends of the plurality of wires in a one-to-one correspondence relationship and the terminating portion electrically connects the plurality of received wires.

Some embodiments are directed to a cable assembly including a cable having a plurality of insulated wires and a plurality of uninsulated wires. Each insulated wire includes a central conductor surrounded by an insulative layer. The insulative layer is removed from an end of each insulated wire to expose the central conductor of the insulated wire. The cable assembly also includes a plurality of electrically conductive signal and ground terminals. Each signal and ground terminal includes a middle portion, a mating portion extending from a first end of the middle portion making electrical contact with a conductive pad, and a terminating portion extending from an opposite second end of the middle portion. The terminating portion of each signal terminal includes a single recessed portion receiving the exposed central conductor of a corresponding insulated wire. The terminating portion of each ground terminal includes two adjacent recessed portions separated by a wall, each recessed portion receiving a corresponding uninsulated wire.

A further aspect of the disclosure relates to an electrically conductive terminal for making electrical and physical contact with a conductive pad. The terminal includes a conductive middle portion, a conductive mating portion extending from a first end of the middle portion for making electrical contact with a conductive pad, and a conductive terminating portion extending from an opposite second end of the middle portion for receiving and terminating a plurality of conductors. The middle portion, the mating portion, and the terminating portion have substantially a same thickness, and wherein the middle portion and the mating portion have substantially a same width smaller than a width of the terminating portion. The terminating portion has a recess for receiving and terminating the plurality of conductors.

These and other aspects of the present application will be apparent from the detailed description below. In no event, however, should the above summaries be construed as limitations on the claimed subject matter, which subject matter is defined solely by the attached claims.

BRIEF DESCRIPTION OF DRAWINGS

The various aspects of the disclosure will be discussed in greater detail with reference to the accompanying figures where, FIG. 1 schematically shows a cable assembly including plurality of signal and ground terminals according to an embodiment.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Figure 1:
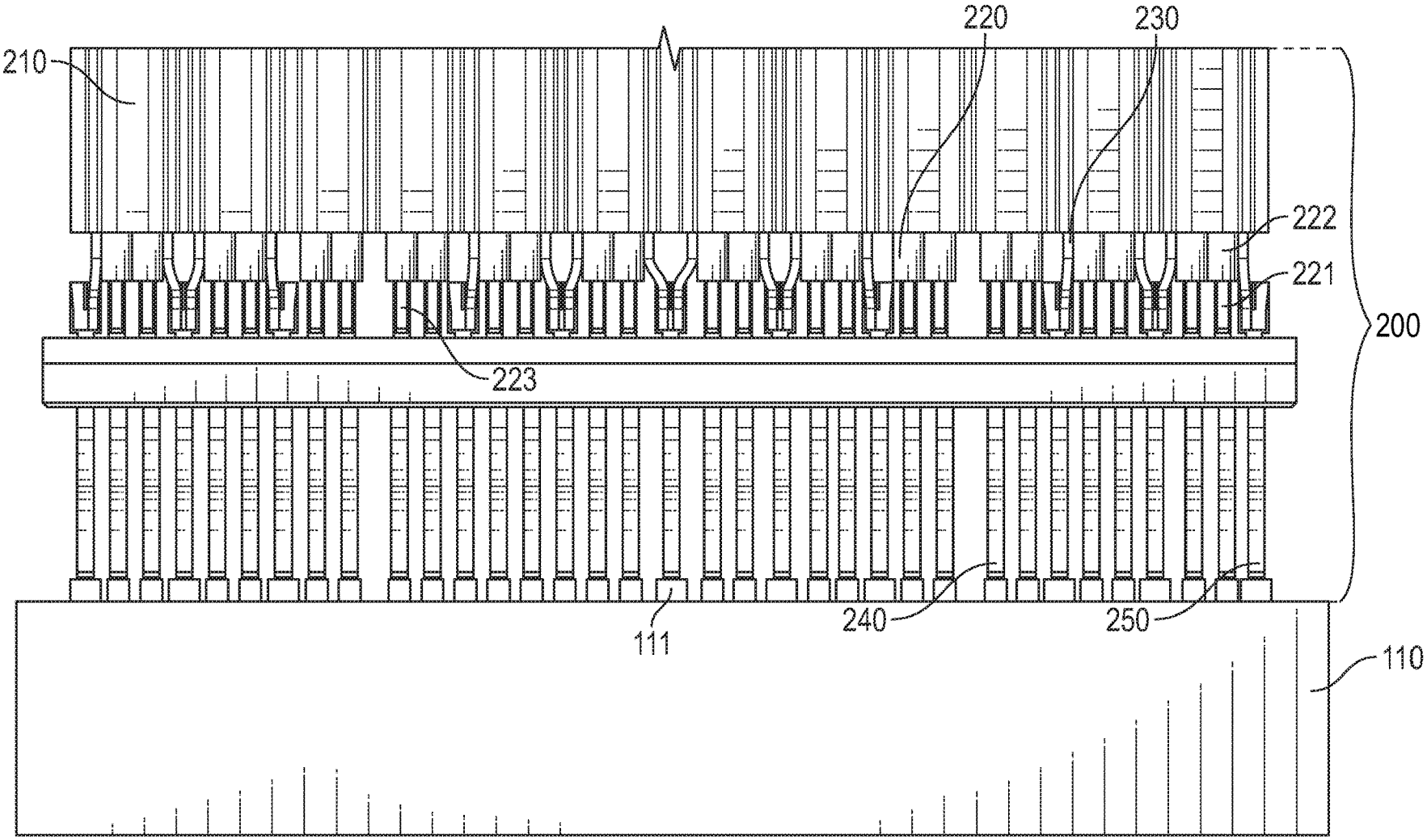
Figure 2:
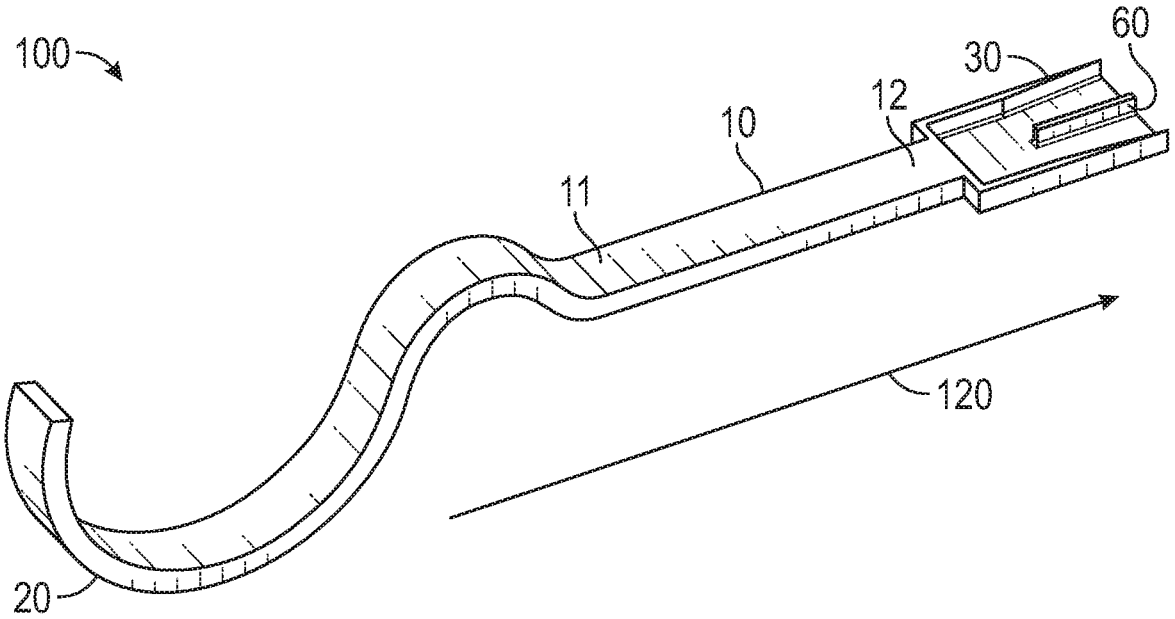
FIG. 2 schematically shows a perspective view of the conductor terminal according to an embodiment.

As illustrated in FIG. 1, a cable assembly 200 includes a cable 210 having a plurality of insulated wires 220 and a plurality of uninsulated wires 230. Each insulated wire 220 includes a central conductor 221 surrounded by an insulative layer 222. So, for example, the insulated wires 220 may be signal wires having a central conductor 221 surrounded by an insulative layer 222. The central conductor 221 at the end of each signal wire 220 may be exposed 223 by removing the insulative layer 222. The uninsulated wires 230 may be ground wires placed between or adjacent to, and in physical contact with, the insulative layer 222 of at least one of the insulated wires 220. The cable assembly further includes a plurality of electrically conductive signal terminals 240 for receiving and terminating the exposed conductors 223 of the insulated wires 220 and a plurality of electrically conductive ground terminals 250 for receiving and terminating the conductors of the uninsulated wires 230. The electrically conductive terminals 240, 250 make solderless electrical contact with respective conductive pads 111. In some embodiments, each signal terminal 240 and ground terminal 250 includes a middle portion, a mating portion extending from a first end of the middle portion making electrical contact with a conductive pad, and a terminating portion extending from an opposite second end of the middle portion as described further elsewhere herein. In some embodiments, as described further elsewhere herein, the terminating portion of each signal terminal 240 includes a single recessed portion 241 receiving the exposed central conductor 223 of a corresponding insulated wire 220, and the terminating portion of each ground terminal 250 includes two adjacent recessed portions separated by a wall, where each recessed portion receives a corresponding uninsulated wire 230.

FIGS. 2-6 schematically illustrate an electrically conductive terminal 100 for making solderless electrical contact with a conductive pad. The conductive terminal 100 extends generally along a first direction 120 and includes a substantially straight conductive middle portion 10 having a first end 11 and an opposite second end 12. A conductive mating portion 20 resiliently compressible in the first direction extends from the first end 11 of the middle portion 10 for making solderless electrical contact with a conductive pad. In an embodiment, at least a portion of the mating portion 20 may be S-shaped. The conductive terminal 100 includes a conductive terminating portion 30 extending from the second end 12 of the middle portion 10 generally along the first direction 120 for making physical and electrical contact to a plurality of wires 40. In some embodiments, the terminating portion 30 is configured to receive exposed conductive ends 41 of the plurality of wires 40 and is configured to electrically connect the plurality of received wires 40. In certain embodiments, the terminating portion 30 may be configured to make physical and electrical contact to a plurality of insulated wires of a cable. In other embodiments, the terminating portion 30 may be configured to make physical and electrical contact to a plurality of uninsulated wires of a cable.

Figure 3:
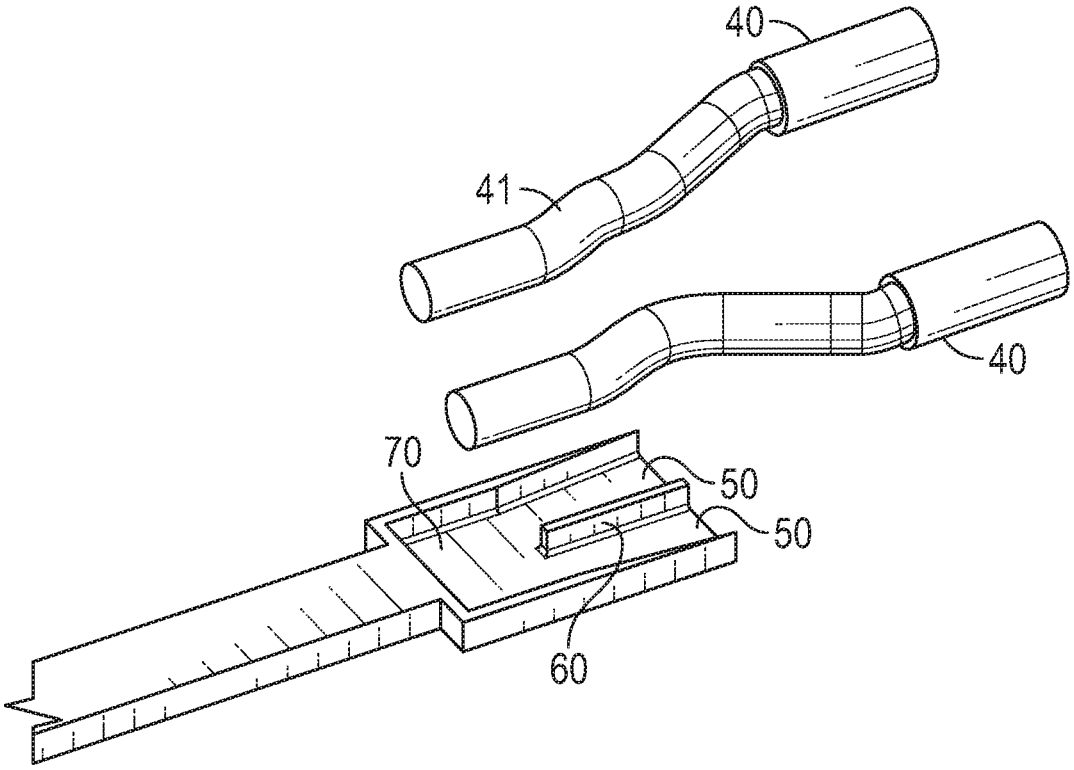
FIGS. 3 and 4 schematically show wires being received by a corresponding conductor terminal.
Figure 4:
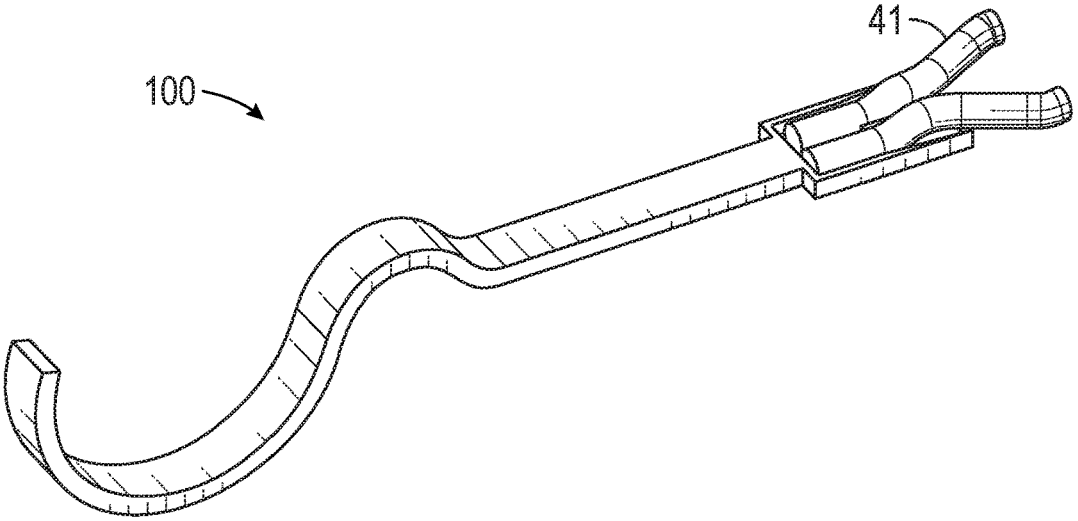

The terminating portion 30 includes a plurality of electrically connected segments 50 separated by one or more electrically conductive walls 60 as best shown in FIG. 3. Each segment in the plurality of electrically connected segments 50 may be configured to receive an exposed conductive end 41 of a wire 40 such that the plurality of segments 50 receive exposed conductive ends 41 of plurality of wires 40 in a one-to-one correspondence relationship.

Figure 5:
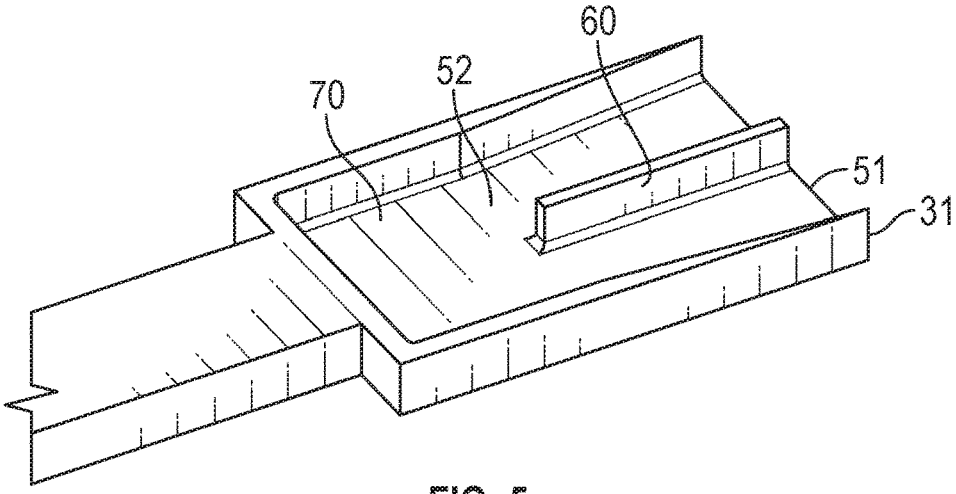
FIG. 5 schematically shows an enlarged view of a terminating portion of the conductor terminal.
Figure 6:
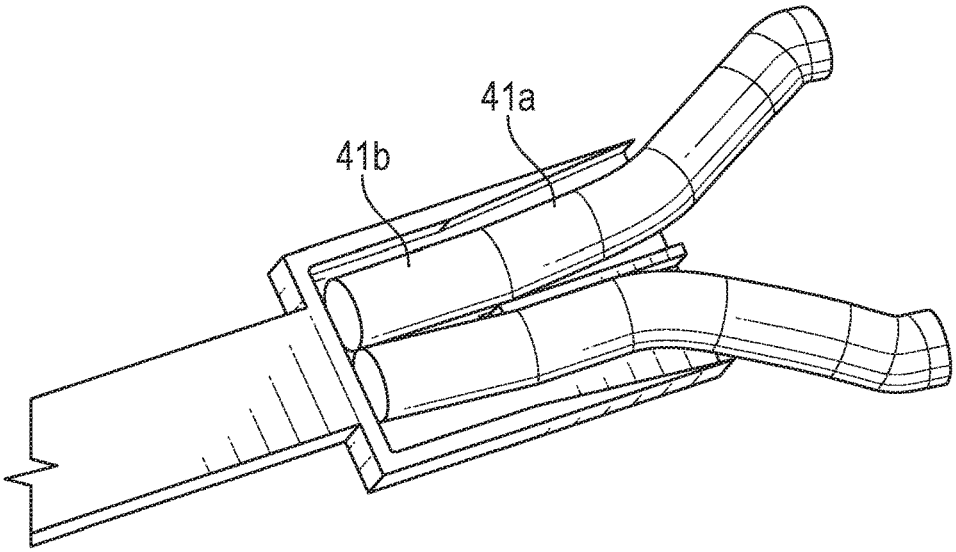
FIG. 6 schematically shows an assembled view of wires on a conductive termination portion of a conductor terminal.

The conductive terminating portion 30 has a free end 31 and a common region 70 as shown in FIG. 5. Each segment 50 in the plurality of electrically connected segments has an open first end 51 at the free end 31 and an opposite open second end 52 at the common region 70. One or more of the electrically conductive walls 60 do not extend into the common region 70 as best seen in FIG. 5. Each exposed conductive end 41 includes a first portion 41*a* and a second portion 41*b* as shown in FIG. 6. When an exposed conductive end 41 of a wire 40 is received in each segment 50, the first portion 41*a* of the exposed conductive end 41 rests in the segment 50 and the second portion 41*b* of the exposed conductive end 41 rests in the common region 70.

The adjacent second portions 41*b* of the exposed conductive ends 41 resting in the common region 70 make physical and electrical contact with one another as best seen in FIG. 6.

Figure 7:
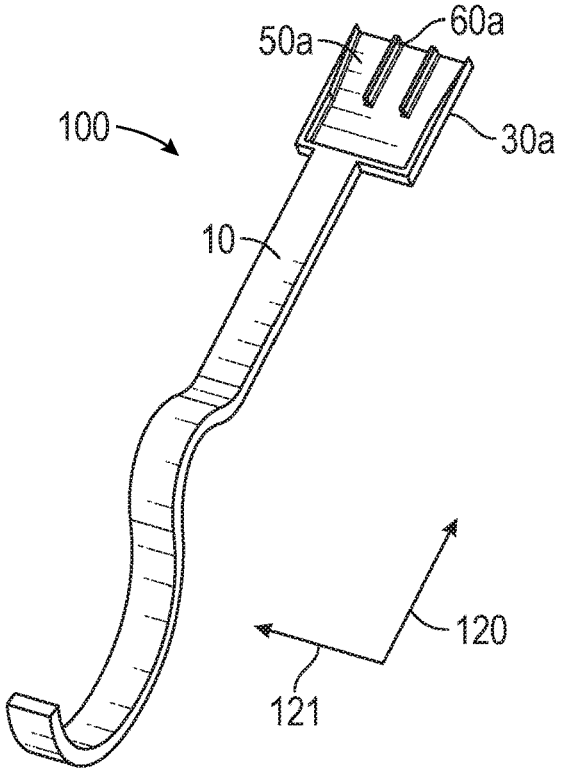
FIGS. 7-10 schematically show perspective views of conductor terminals according to different embodiments.
Figure 8:
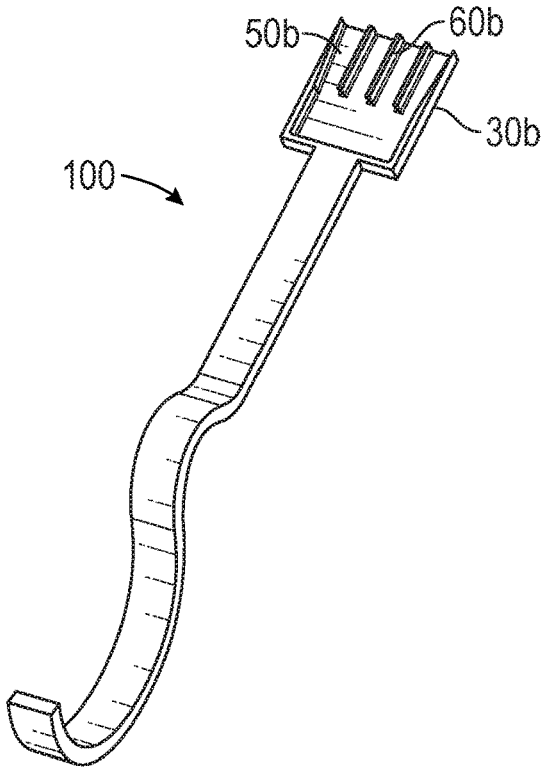

In one aspect, the conductive terminating portion 30 of the terminal 100 includes two electrically connected segments 50 separated by an electrically conductive wall 60 as seen in FIGS. 2-6. In another aspect, the conductive terminating portion 30*a* of each terminal 100 includes at least three electrically connected segments 50*a*, each pair of adjacent segments separated by an electrically conductive wall 60*a* as illustrated in FIG. 7. In another aspect, the conductive terminating portion 30*b* of each terminal 100 includes at least four electrically connected segments 50*b*, each pair of adjacent segments separated by an electrically conductive wall 60*b*, as illustrated in FIG. 8.

Figure 9:
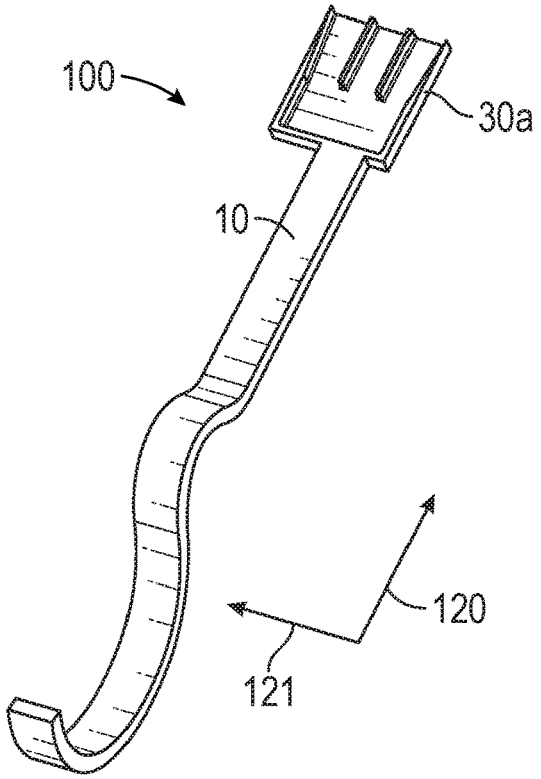

Referring now to FIGS. 7 and 9, the conductive terminating portion 30*a* may be offset relative to the middle portion 10 in a transverse direction 121 perpendicular to the first direction 120.

As illustrated in FIGS. 11A-11D, according to certain embodiments, the middle portion 10, the mating portion 20, and the terminating portion 30 of the terminal 100 have substantially a same thickness H. The middle portion 10 and the mating portion 20 have substantially a same width W1 smaller than a width W2 of the terminating portion 30.

In an embodiment of the cable assembly 200 schematically illustrated in FIG. 1, the terminating portion of each electrically conductive signal terminal 240 includes a single recessed portion 241 as shown in FIGS. 12A-12D for receiving the exposed central conductor 223 of a corresponding insulated wire. The signal terminal 240 with a single recessed termination portion 241 has a middle portion 10, a mating portion 20, and a terminating portion 30 having substantially a same thickness H and substantially a same width W.

In some embodiments of the cable assembly 200 schematically illustrated in FIG. 1, the terminating portion of each ground terminal 250 includes at least two adjacent recessed portions 50, 50*a*, 50*b* separated by a wall 60, 60*a*, 60*b* as explained earlier with reference to FIGS. 2-9, each recessed portion receiving a corresponding uninsulated wire.

Figure 10:
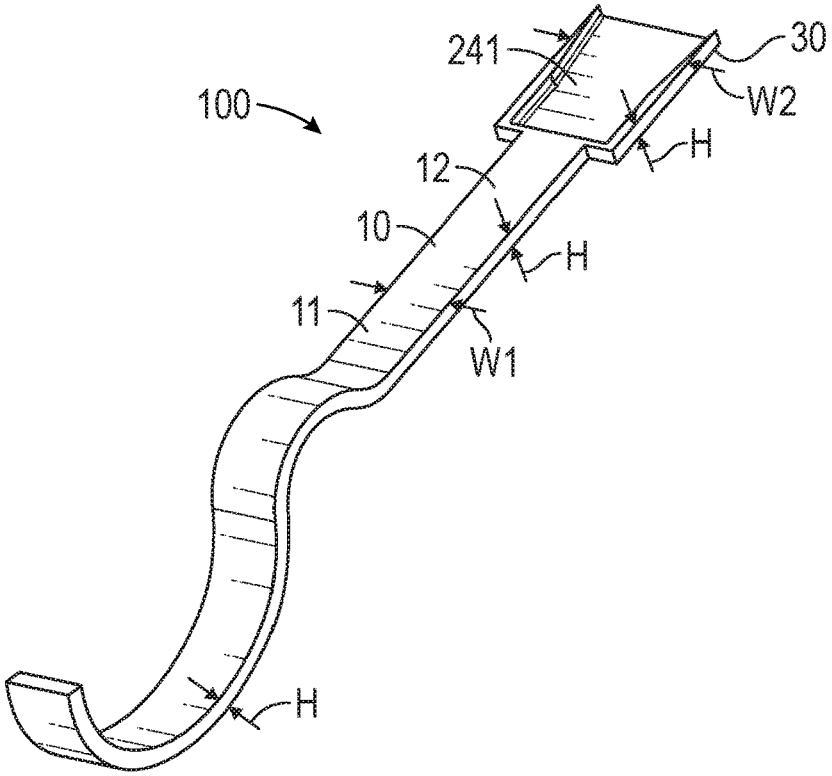
Figure 11A:
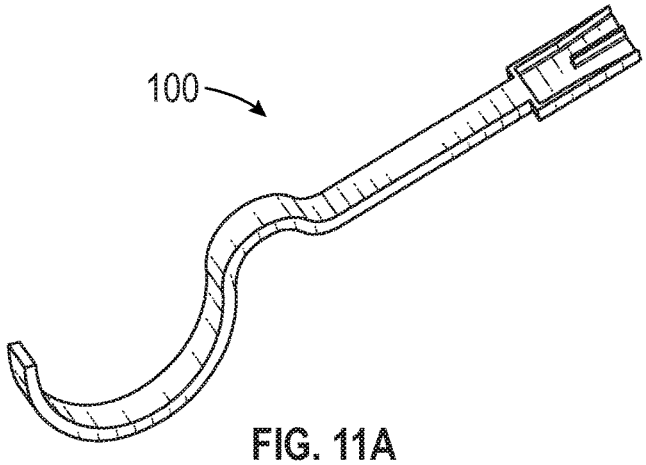
FIGS. 11A-11D schematically shows the different views of a conductor terminal according to an embodiment.
Figure 11B:
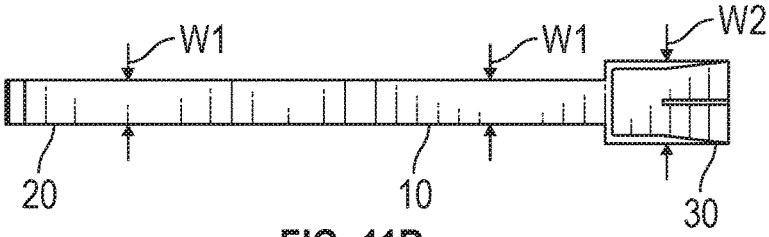
Figure 11C:
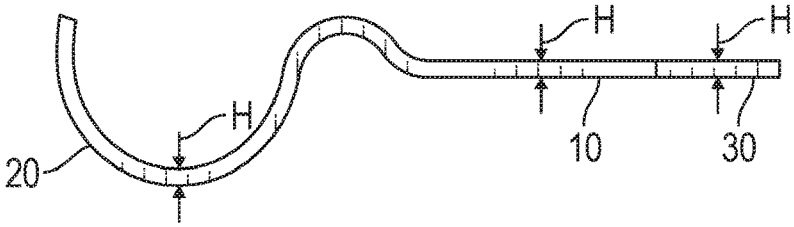
Figure 11D:
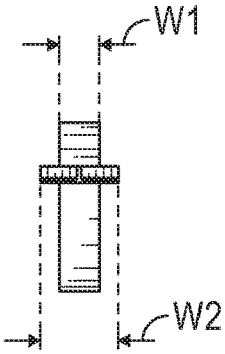
Figure 12A:
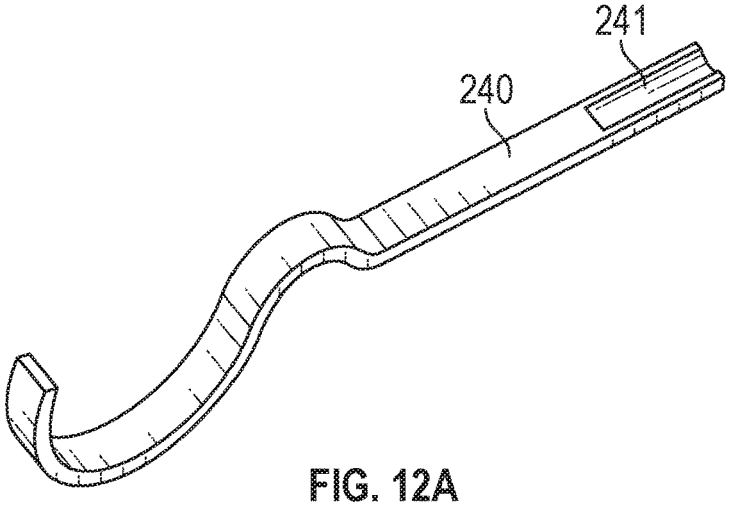
FIGS. 12A-12D schematically shows different views of the conductor terminal according to an embodiment.
Figure 12B:
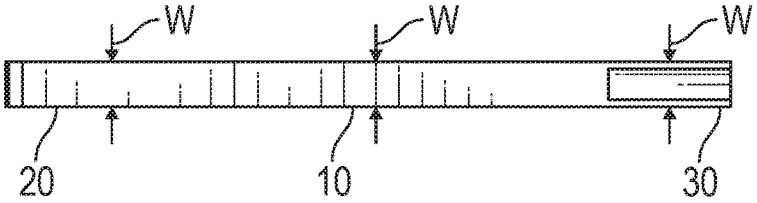
Figure 12C:
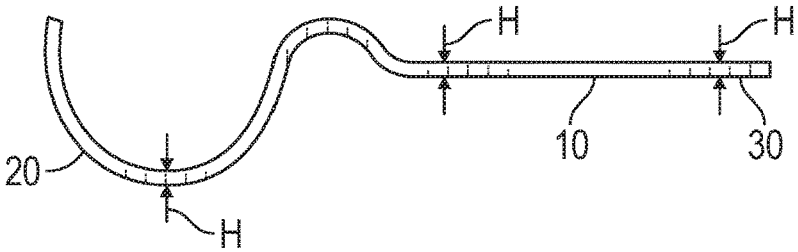
Figure 12D:
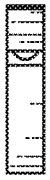

In certain aspects, as best seen in FIG. 10, an electrically conductive terminal 100 for making electrical and physical contact with a conductive pad includes a conductive middle portion 10 and a conductive mating portion 20 extending from a first end 11 of the middle portion 10 for making electrical contact with a conductive pad. A conductive terminating portion 30 extends from an opposite second end 12 of the middle portion 10 for receiving and terminating a plurality of conductors. The middle portion 10, the mating portion 20, and the terminating portion 30 have substantially a same thickness H. The middle portion 10 and the mating portion 20 have substantially a same width W1 smaller than a width W2 of the terminating portion 30. The terminating portion 30 includes a recess 241 for receiving and terminating the plurality of conductors.

Embodiments disclosed herein include:

Embodiment 1.

An electrically conductive terminal for making solderless electrical contact with a conductive pad, the terminal generally extending along a first direction and including: a substantially straight conductive middle portion; a conductive mating portion extending from a first end of the middle portion generally along the first direction for making solderless electrical contact with a conductive pad, the mating portion resiliently compressible in the first direction; and a conductive terminating portion extending from an opposite second end of the middle portion generally along the first direction for making physical and electrical contact to a plurality of wires, the terminating portion including a plurality of electrically connected segments separated by one or more electrically conductive walls and configured to receive exposed conductive ends of the plurality of wires in a one-to-one correspondence relationship, the terminating portion electrically connecting the plurality of received wires.

Embodiment 2.

The electrically conductive terminal of Embodiment 1, wherein for each segment in the plurality of electrically connected segments, the segment includes: an open first end at a free end of the conductive terminating portion; and an opposite open second end at a same common region, wherein the one or more electrically conductive walls do not extend into the common region, such that when an exposed conductive end of a wire is received in each segment, a first portion of the exposed conductive end of the wire rests in the segment and a second portion of the exposed conductive end rests in the common region.

Embodiment 3.

The electrically conductive terminal of Embodiment 2, wherein the adjacent second portions of the exposed conductive ends of the wires resting in the common region make physical and electrical contact with one another.

Embodiment 4.

The electrically conductive terminal of Embodiment 1, wherein at least a portion of the mating portion of each terminal is S-shaped.

Embodiment 5.

The electrically conductive terminal of Embodiment 1, wherein the conductive terminating portion of each terminal includes two electrically connected segments separated by an electrically conductive wall.

Embodiment 6.

The electrically conductive terminal of Embodiment 1, wherein the conductive terminating portion of each terminal includes at least three electrically connected segments, each pair of adjacent segments separated by an electrically conductive wall.

Embodiment 7.

The electrically conductive terminal of Embodiment 1, wherein the conductive terminating portion of each terminal includes at least four electrically connected segments, each pair of adjacent segments separated by an electrically conductive wall.

Embodiment 8.

The electrically conductive terminal of Embodiment 1, wherein the terminating portion is offset relative to the middle portion in a transverse direction perpendicular to the first direction.

Embodiment 9.

The electrically conductive terminal of Embodiment 1, wherein the middle portion, the mating portion, and the terminating portion have substantially a same thickness; and the middle portion and the mating portion have substantially a same width smaller than a width of the terminating portion.

Embodiment 10.

The electrically conductive terminal of Embodiment 1, wherein the terminating portion is configured to make physical and electrical contact to a plurality of insulated wires.

Embodiment 11.

The electrically conductive terminal of Embodiment 1, wherein the terminating portion is configured to make physical and electrical contact to a plurality of uninsulated wires.

Embodiment 12.

A cable assembly, including: a cable including a plurality of insulated wires and a plurality of uninsulated wires, each insulated wire including a central conductor surrounded by an insulative layer, the insulative layer removed from an end of each insulated wire to expose the central conductor of the insulated wire; and a plurality of electrically conductive signal and ground terminals, each signal and ground terminal including: a middle portion; a mating portion extending from a first end of the middle portion making electrical contact with a conductive pad; and a terminating portion extending from an opposite second end of the middle portion, the terminating portion of each signal terminal including a single recessed portion receiving the exposed central conductor of a corresponding insulated wire, the terminating portion of each ground terminal including two adjacent recessed portions separated by a wall, each recessed portion receiving a corresponding uninsulated wire.

Embodiment 13.

An electrically conductive terminal for making electrical and physical contact with a conductive pad, the terminal including: a conductive middle portion; a conductive mating portion extending from a first end of the middle portion for making electrical contact with a conductive pad; and a conductive terminating portion extending from an opposite second end of the middle portion for receiving and terminating a plurality of conductors, wherein the middle portion, the mating portion, and the terminating portion have substantially a same thickness, and wherein the middle portion and the mating portion have substantially a same width smaller than a width of the terminating portion, the terminating portion including a recess for receiving and terminating the plurality of conductors.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

The invention claimed is:

1. An electrically conductive terminal for making solderless electrical contact with a conductive pad, the terminal generally extending along a first direction and comprising:

a substantially straight conductive middle portion;

a conductive mating portion extending from a first end of the middle portion generally along the first direction for making solderless electrical contact with a conductive pad, the mating portion resiliently compressible in the first direction; and a conductive terminating portion extending from an opposite second end of the middle portion generally along the first direction for making physical and electrical contact to a plurality of wires, the terminating portion comprising a plurality of electrically connected segments separated by one or more electrically conductive walls and configured to receive exposed conductive ends of the plurality of wires in a one-to-one correspondence relationship, the terminating portion electrically connecting the plurality of received wires, wherein the middle portion and the terminating portion have substantially a same thickness.

2. The electrically conductive terminal of claim 1, wherein for each segment in the plurality of electrically connected segments, the segment comprises:

an open first end at a free end of the conductive terminating portion; and an opposite open second end at a same common region, wherein the one or more electrically conductive walls do not extend into the common region, such that when an exposed conductive end of a wire is received in each segment, a first portion of the exposed conductive end of the wire rests in the segment and a second portion of the exposed conductive end rests in the common region.

3. The electrically conductive terminal of claim 2, wherein the adjacent second portions of the exposed conductive ends of the wires resting in the common region make physical and electrical contact with one another.

4. The electrically conductive terminal of claim 1, wherein at least a portion of the mating portion of each terminal is S-shaped.

5. The electrically conductive terminal of claim 1, wherein the conductive terminating portion of each terminal comprises two electrically connected segments separated by an electrically conductive wall.

6. The electrically conductive terminal of claim 1, wherein the conductive terminating portion of each terminal comprises at least three electrically connected segments, each pair of adjacent segments separated by an electrically conductive wall.

7. The electrically conductive terminal of claim 1, wherein the conductive terminating portion of each terminal comprises at least four electrically connected segments, each pair of adjacent segments separated by an electrically conductive wall.

8. The electrically conductive terminal of claim 1, wherein the terminating portion is offset relative to the middle portion in a transverse direction perpendicular to the first direction.

9. The electrically conductive terminal of claim 1, wherein:

the middle portion, the mating portion, and the terminating portion have substantially a same thickness; and the middle portion and the mating portion have substantially a same width smaller than a width of the terminating portion.

10. The electrically conductive terminal of claim 1, wherein the terminating portion is configured to make physical and electrical contact to a plurality of insulated wires.

11. The electrically conductive terminal of claim 1, wherein the terminating portion is configured to make physical and electrical contact to a plurality of uninsulated wires.

12. A cable assembly, comprising:

a cable comprising a plurality of insulated wires and a plurality of uninsulated wires, each insulated wire comprising a central conductor surrounded by an insulative layer, the insulative layer removed from an end of each insulated wire to expose the central conductor of the insulated wire; and a plurality of electrically conductive signal and ground terminals, each signal and ground terminal comprising:

a middle portion;

a mating portion extending from a first end of the middle portion making electrical contact with a conductive pad; and a terminating portion extending from an opposite second end of the middle portion, the middle portion and the terminating portion having substantially a same thickness, the terminating portion of each signal terminal comprising a single recessed portion receiving the exposed central conductor of a corresponding insulated wire, the terminating portion of each ground terminal comprising two adjacent recessed portions separated by a wall, each recessed portion receiving a corresponding uninsulated wire.

13. An electrically conductive terminal for making electrical and physical contact with a conductive pad, the terminal comprising:

a conductive middle portion;

a conductive mating portion extending from a first end of the middle portion for making electrical contact with a conductive pad; and a conductive terminating portion extending from an opposite second end of the middle portion for receiving and terminating a plurality of conductors, wherein the middle portion, the mating portion, and the terminating portion have substantially a same thickness, and wherein the middle portion and the mating portion have substantially a same width smaller than a width of the terminating portion, the terminating portion comprising a recess for receiving and terminating the plurality of conductors.

* * * * *